US005088434A

United States Patent [19]

Harding

[11] Patent Number: 5,088,434

[45] Date of Patent: Feb. 18, 1992

[54] INFLATABLE BOAT AND DECK THEREFOR

[75] Inventor: Richard J. A. Harding, Trimsaran, Great Britain

[73] Assignee: Avon Inflatables Limited, Wilshire, England

[21] Appl. No.: 629,820

[22] Filed: Dec. 21, 1990

[30] Foreign Application Priority Data

Dec. 21, 1989 [GB] United Kingdom ..... 8928881

[51] Int. Cl.[5] ..... B63B 7/02

[52] U.S. Cl. ..... 114/85; 114/345

[58] Field of Search ..... 441/129-132, 441/35, 38, 40; 114/343, 345, 354, 355, 357, 358, 364, 85, 264, 266, 267; 52/586, 588; 403/291, 294; 256/1, 23

[56] References Cited

U.S. PATENT DOCUMENTS

| | | | |
|---|---|---|---|
| 2,747,537 | 5/1956 | Kummerman | 114/85 |
| 3,348,459 | 10/1967 | Harvey | 52/586 |
| 3,451,078 | 6/1969 | Edwards | 114/354 |
| 3,592,289 | 7/1971 | Aysta | 52/586 |
| 3,608,112 | 9/1971 | Irgenis | 114/345 |
| 3,659,298 | 5/1972 | Edwards | 114/245 |
| 3,779,197 | 12/1973 | Hawkins | 114/85 |
| 4,724,792 | 2/1988 | Cochran | 114/345 |
| 4,777,777 | 10/1988 | Massimo | 52/586 |
| 4,807,555 | 2/1989 | Hart | 114/345 |
| 4,858,550 | 8/1989 | Bellia | 114/345 |
| 4,892,052 | 1/1990 | Zook | 114/85 |

FOREIGN PATENT DOCUMENTS

| | | |
|---|---|---|
| 980705 | 1/1965 | United Kingdom . |
| 1097781 | 1/1968 | United Kingdom . |
| 2060503 | 5/1981 | United Kingdom . |

OTHER PUBLICATIONS

"Avon The Unbeatable inflatables", Oct. 1989, pp. 1-40.

*Primary Examiner*—Joseph F. Peters, Jr.
*Assistant Examiner*—Clifford T. Bartz
*Attorney, Agent, or Firm*—Cushman, Darby & Cushman

[57] ABSTRACT

A deck apparatus is disclosed containing interengagement means between an inflatable boat and a plurality of adjacent deck elements which are joined by a resilient link. The interengagement means prevent relative vertical movements of the adjacent deck elements and substantially all angular movement in one direction, but freely permit relative angular movement in the other direction whereby the adjacent deck elements may be folded on top of one another with the link allowing in principle, 180 degrees of relative rotation.

25 Claims, 4 Drawing Sheets

INFLATABLE BOAT AND DECK THEREFOR

FIELD OF THE INVENTION

This invention relates to decks for inflatable boats and to inflatable boats incorporating such decks.

BACKGROUND OF THE INVENTION

Various folding decks have been known, with longitudinal folds (GB-A-980705) or, more commonly, lateral ones (US-A-3659298). FIG. 4 of the latter document shows how an integral hinge strip may join two panels. It has also been known for the deck of an inflatable boat to consist of widely spaced-apart laterally-extending parallel planks held in a loose assembly by webbing strips running lengthwise of the boat and securing each of the planks. See the catalogue "Avon The Unbeatable Inflatables", October 1989, at p.11. Such a construction may be rolled up, but it lacks strength and coherence in its planar condition.

SUMMARY OF THE INVENTION

In contrast, the present invention is concerned to provide a deck which can be folded up in one sense of rotation but which is highly resistive to load and tension when in its extended condition in the boat. In such a deck articulations are formed by links between adjacent elements such that those adjacent elements may in principle execute a relative rotation of substantially 180°. We say "in principle" because in practice the presence of other elements in the fold, or of other parts of the boat, will prevent most if not all of the elements from executing the full potential rotation.

Furthermore, the elements are interengaged in the essentially planar condition of the deck by means resisting relative translational movement of adjacent elements perpendicular to that plane, but these means disengaging upon a predetermined degree of angular movement of these elements.

The elements may be one-piece integral wholes, or may comprise edge capping sections bearing the link and engagement means and discrete panels engaged by the capping sections.

The elements will advantageously be of uniform section and normally be extruded (but may be moulded or otherwise formed) from an essentially rigid material such as a rigid metal e.g. aluminium or rigid plastics, e.g. high-impact PVC such as WELVIC RG8/860 or ATOCHEM ZR0177. The flexible links also may be of uniform section and also may be extrusions; however they may alternatively be mouldings. A synthetic rubber such as a thermoplastic elastomer or more specifically EVOPRENE or ALCRYN is especially suitable for these. One preferred section for the flexible links has an integral enlarged portion at each end, as seen in a cross-section of the link these enlargements being made to fit respectively into restricted mouths of channels in the adjacent slat-like elements. However, one or more ends (as seen in cross-section) of the link may be permanently secured in the element(s). The length of these links and elements will preferably be equal or substantially so.

The elements and links will normally be disposed laterally in the boat and the sense in which they can fold-up will normally be that in which the beginning of the folding-up action is in an upward direction. It is proposed that the deck may extend laterally to be entrapped at its edges under the overhang of the buoyancy tube or tubes which are at the sides of the boat and may be held in the tapering intersection formed between the lower portion of that tube or tubes and the flexible fabric floor of the boat. In this case, the entire boat may be folded-up together with the deck once the buoyancy tubes have been deflated.

The boat fitted with the deck may work somewhat in rough water and the flexible links should be such as to allow a few degrees of relative rotation in the nominally prohibited sense to accommodate such motion.

End caps may be fitted over the lateral ends of the elements and may in their simplest form be a U-section constant profile moulding or extrusion of which the limbs of the U fit respectively within or over and below the upper and lower surfaces of the elements. However, it is preferred that such end caps should be a compound element having the U-section as before but bearing on the outer surface of the base of the U a soft element to engage snugly in the intersection between the hull and the inflatable tube to inhibit any chafing action.

A preferred section of the slat-like elements is hollow, and provision may be made for reinforcement of the section by insertion of additional structural elements in the hollow as may be needed for example for an inflatable boat of large beam.

Adjacent element preferably have interengaging portions which when the elements are in their extended position and forming a deck for the inflated boat resist relative dislodgement of the elements.

BRIEF DESCRIPTION OF THE DRAWINGS

A particular embodiment of the invention will now be described with reference to the accompanying drawings wherein.

DESCRIPTION OF PREFERRED EMBODIMENTS

Figure 5:
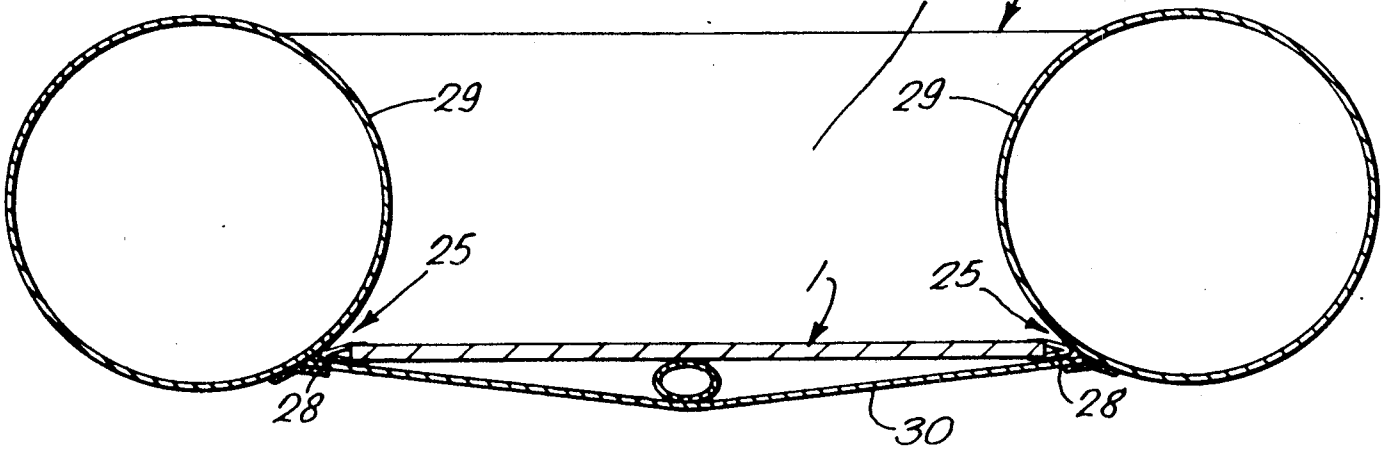
FIG. 5 is a part-section of an inflated boat with the deck in position.

Slat-like elements 1 lie side by side to form a deck of an inflatable boat (51, FIG. 5) and are made of a constant section hollow extrusion of a rigid plastics material such as ATOCHEM ZR0177. An upper surface 2 on an upper skin of a deck section, has raised ridges or grooves for improved grip on that surface by those walking on it. Internal partitions 4 space the upper skin away from the lower skin offering a lower surface 5. In at least some of the compartments formed by partitions 4 locator ridges 6 may be positioned so that strengthening battens 7 may be located within the elements to give them added rigidity if need be. At one side 8 each element has at the side of the upper skin a restricted mouth 9 opening to an enlarged channel 10, and the lower skin projects into a shelf 11 defining a recess 12 above it. The shelf 11 may be discontinuous along the element between the recess 12 and the channel 10 a flange which defines also one side of the mouth 9 has a face 13 which is perpendicular to the upper and lower skins.

Figure 1:
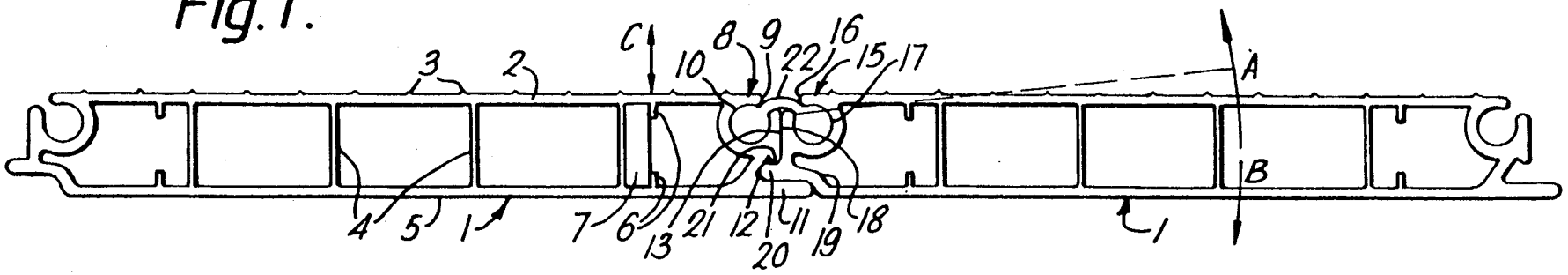
FIG. 1 is an end view of two adjacent elements of a roll-up deck, joined by a flexible link.

At the other side 15 of the elements there is likewise a restricted mouth 16 resembling mouth 9 opening to a channel 17 also defined by an end wall having an end face 18 perpendicular to the upper and lower skins. The mid-planes of the channels 10, 17 lie at an angle, here 45° to the planes of the surfaces 2, 5. Below the end wall 18 the lower skin 5 is cranked upwards at 19 to project into a ledge 20. When the elements are lying generally coplanar as shown in FIG. 1 and as they are in an inflated boat, they interengage in that the ledge 20 enters into recess 12 and is held there against twisting or other dislodgement e.g relative translation in the sense of arrow C by interaction between the shelf 11 and a nose 21 at the bottom of the wall 13; at the same time the walls 13 and 18 butt together. Ledge 20, like shelf 11, may be discontinuous along the length of the elements.

Figure 2:
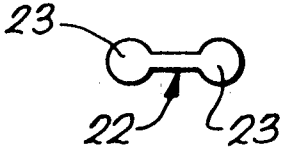
FIG. 2 is an end view of the flexible link section.

The elements are held together side by side by the presence in the channels 10, 17 of a link such as flexible link 22 best seen in FIG. 2. The link 22 is of constant dumb-bell section and is formed for example by moulding or extrusion from a rubber or thermoplastic material or fabricated from reinforced fabric or other flexible materials. The enlarged beads 23 are fitted to the adjacent elements by being slid laterally into the channels 10, 17. The link preferably is integrally of a length almost equal to the length of the elements thus forming a continuous surface at the hinge which it forms between them. Notice that the height of the walls 13, 18 is such that the link element is bowed when it fits in the channels but does not substantially project above the upper surface of the upper skin of the adjacent elements. The beads 23 at the ends of the dumb-bell section link 22 are of course of a dimension to be a sliding fit in the channels 10, 17 and to be prevented from bodily movement out of them by the restricted mouths 9, 16. The length, seen in end view, of the link may be such that it is under tension between the elements when the latter are coplanar.

Figure 3A:
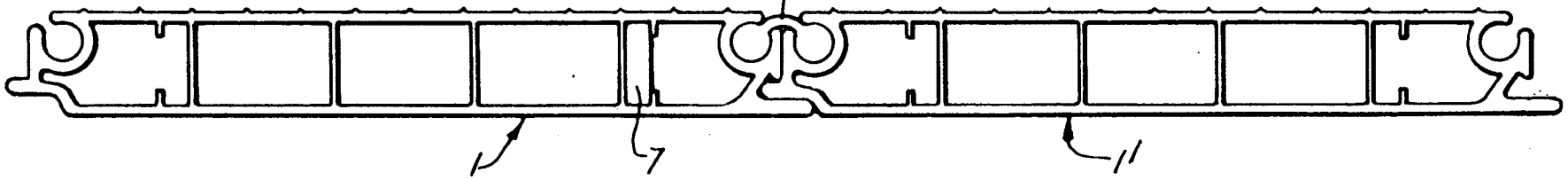
FIG. 3*a*, b and c show the elements in course of a rolling-up rotation.
Figure 3B:
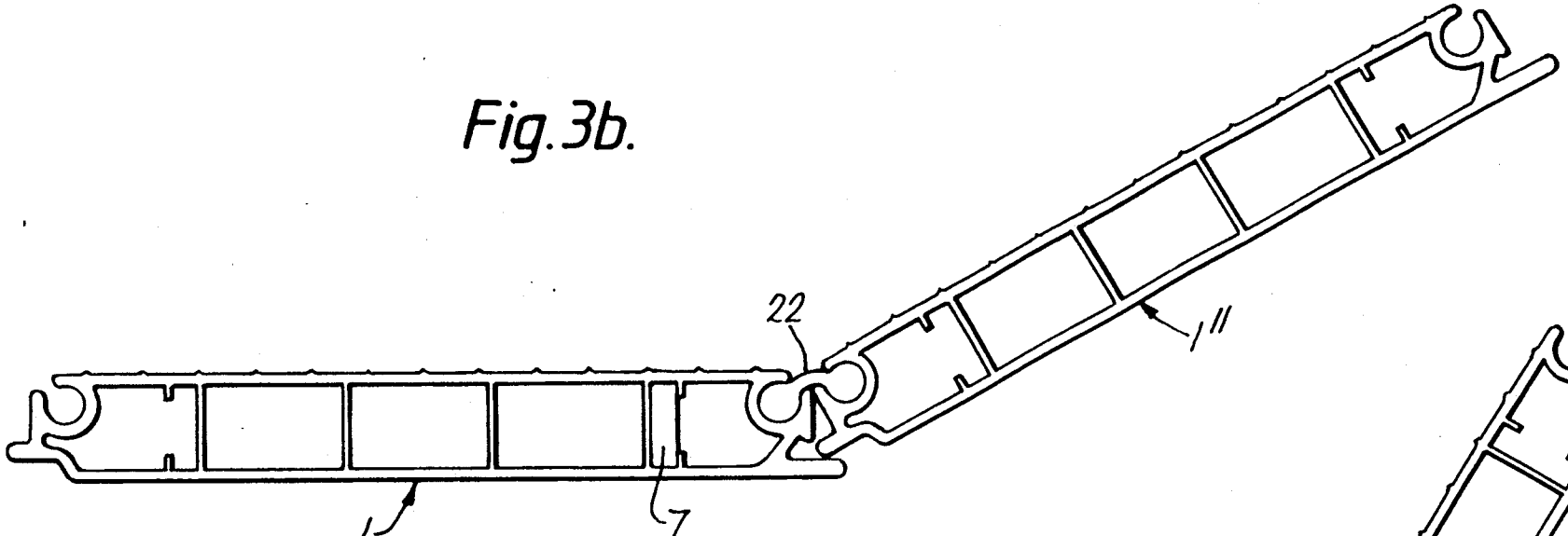
Figure 3C:
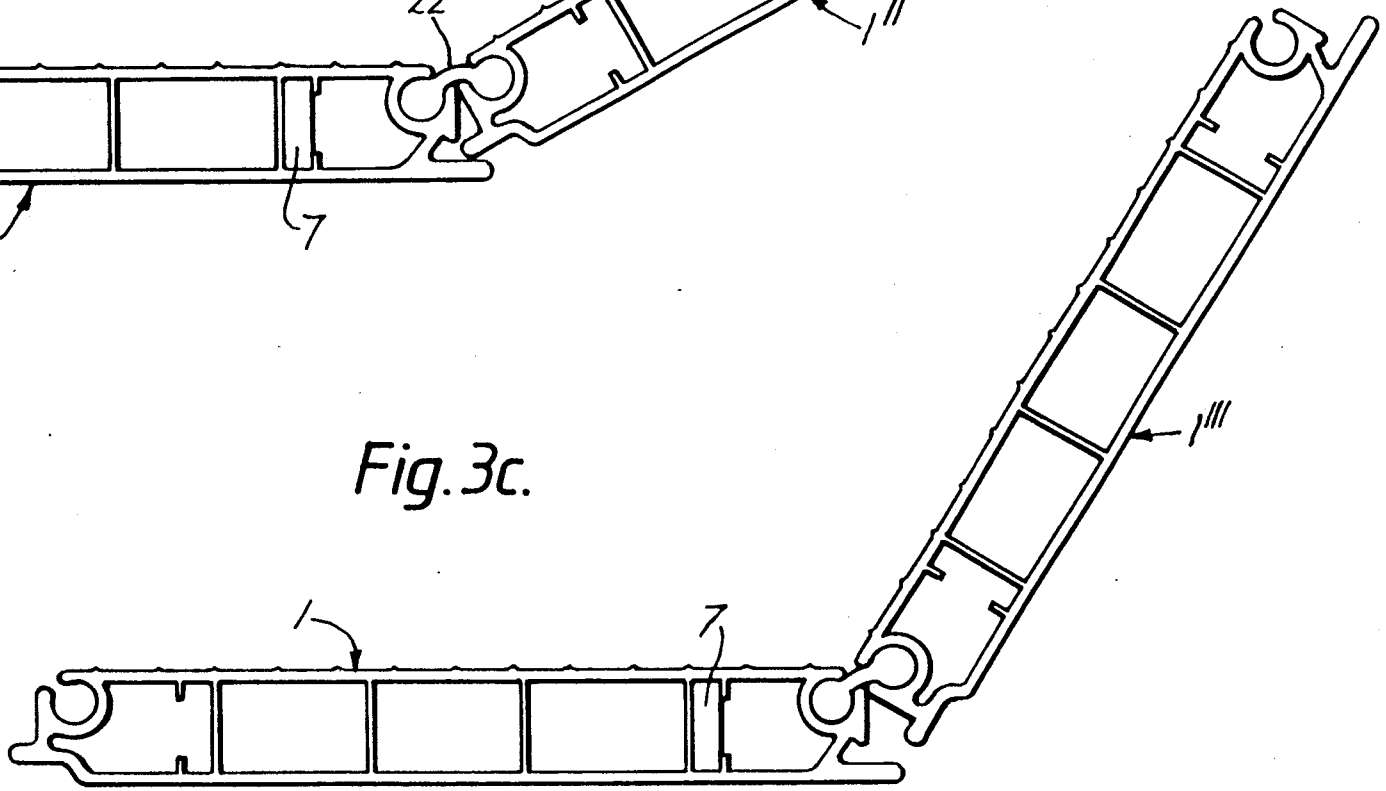

The structure of the flexible links is such that rotation of one element relative to the other is possible in principle over 180° in the sense of the arrow A of FIG. 1. By distortion and slight stretching of the flexible link a few degrees of relative rotation may be possible in the direction of the arrow B. The rotation in the sense of the arrow A allows the elements to be rolled-up in the manner which is shown in FIGS. 3*a*, b and c with an element 1' being shown in three progressive rolled-up positions 1'', 1''' respectively. The length of the flexible link and the fact that the mid-planes of the channels lie at an angle means that the upper surfaces 2 of adjacent elements 1 and 1' may overlie each other face-to-face i.e. having rotated 180° relatively, without strain. As can be seen from these figures the engagement means become disengaged at a predetermined angle of relative rotation, here about 30 °.

However when the deck is being folded-up the full 180° of movement will not be used for most of the elements because of the presence of other such elements and/or because the deck is still in a boat with the latter in deflated condition. Then, the deck remains lodged in (or may be attached to) the boat.

Figure 4:
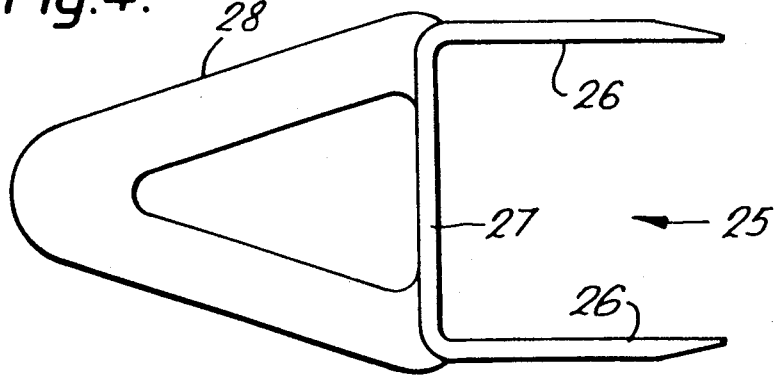
FIG. 4 shows an end view of an end cap for the elements.

To prevent dislodgement of the flexible links along the direction of the channels 10, 17 as well as to lessen any chafing end caps may be fitted on the elements individually, at each end. FIG. 4 shows such an end cap 25 which has a substantially rigid U-shaped section with legs 26 and base 27 and on the undersurface of the base 27 a hollow nose 28 of soft e.g. elastomeric material. Such a section can readily be formed by co-extrusion in a manner which is well-known in the art. The distance apart of the legs 26 of the U are such that they form a snug fit respectively above and below the upper and lower skins 2 and 5 of each element. Alternatively of course the legs could be spaced to fit between the skins. The deck is fitted in the boat with the elements extending laterally across it so it folds-up from either the fore or aft directions, with the end cap 25 and in particular the soft nose 28 fitting into the V taper formed between buoyancy tubes 29 at the lateral sides of the boat and the flexible fabric floor 30 of the boat. A the bow and stern of the boat, and in particular at the region of the transom 52, the nose 28 may be omitted, the end cap then being a simple U-section channel which may be fitted to the exposed sides 8,15 of the elements.

In order to prevent forward movement of the deck this channel may be used to retain the deck in position by providing location for a reinforced fabric flap which may be fitted underneath a transom batten.

Further embodiments of the invention are seen in FIGS. 6 to 9.

Figure 6:
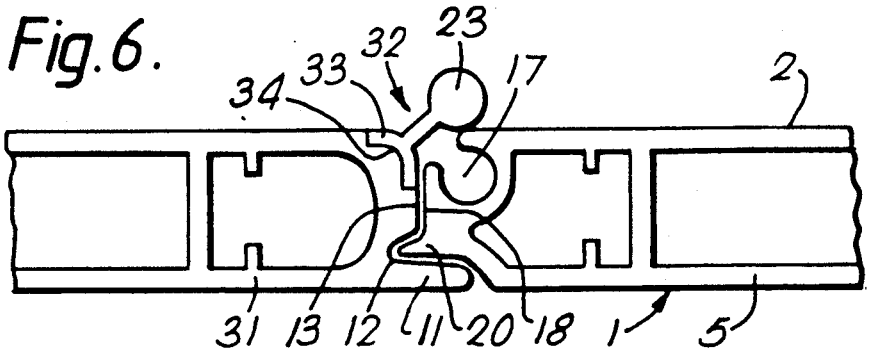
FIGS. 6 to 9 are end views of further embodiments.

FIG. 6 illustrates how flexible link 32 analogous in its function to link 22 may be permanently secured to one side only of each of the element 31. At one of its ends link 32 has an enlarged bead 23 which is for engagement in channel 17 as before. At its other end the link 32 has a foot 33 which is bonded in a recess 34 in element 31 or to the surface of element 31. When element 31 is extruded from plastics material, it and element 32 may be coextruded. The functioning of other parts given the same numbering as in the previously described embodiment is the same as described with respect to that embodiment in this one as well as in the embodiments of FIGS. 7 to 9.

All those Figures show how the present invention may be achieved where the link extends between capping sections running along adjacent edges of separate deck panels. Such composite elements are given the general reference 61.

Figure 7:
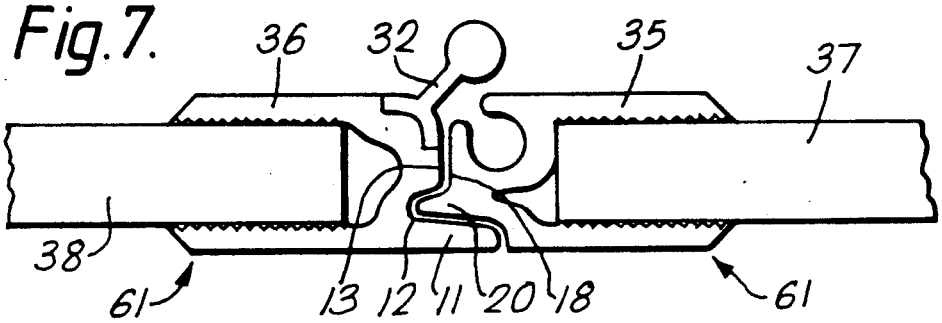

In FIG. 7 the construction of the link and of interengaging parts is exactly as in FIG. 6, but these parts are born on capping sections 35, 36 respectively engaged over the adjacent edges of deck panels 37, 38 (here shown as solid, but which could equally well be hollow) to form the deck elements 61.

Figure 8:
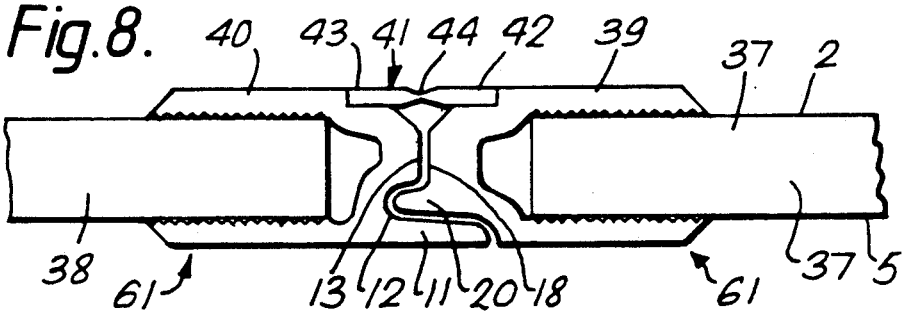

In FIG. 8, capping sections 39, 40 have a link 41 in the form of a waisted strip the end portions 42, 43 of which in cross-section are permanently secured to the sections 39, 40 either by bonding or by having been formed in co-extrusion with them. The waist 44 defines a preferred line of pivot. If co-extrusion is used, this will preferably be done with the capping sections hinged part open at an angle of say 30° to each other.

Figure 9:
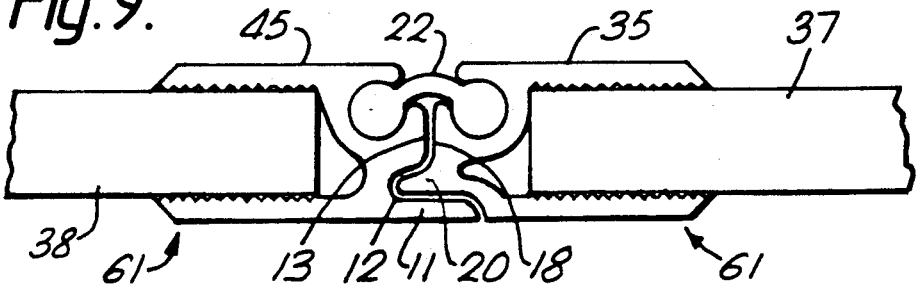

FIG. 9 shows how link 22 may be used with capping sections 35, 45 respectively, whose end view mimics that of the edge portions of the elements 1 of the first embodiment.

An end cap such as 25 may be utilized in order to prevent forward movement of the deck in the boat by providing location for a reinforced fabric flap which may be fitted underneath a batten of a transom.

A boat with a deck of such elements has a deck of substantial strength both against cargo or passengers depressing it and against torsional distortion when the boat works, but the deck can be readily folded up either as a separate entity or while remaining within the boat assembly, the deflated tubes 29 then being flattened down on top of it and continuing to maintain the deck in its assembled position.

In the drawings, only two elements have been shown interlinked; of course a comparatively large number will be used to form the deck of a boat (for example 14 to 15 for a 3 m boat) and all may be similarly interlinked.

The width (in end view) of the elements will be chosen as a compromise between easy rollability which would imply very numerous narrow elements and the cost of production and assembly of such very numerous elements. Exemplary widths may be between 50 and 400 mm with widths of the order of 140–150 mm being the norm.

Not all elements need be of the same width, and in boats with a permanently mounted rigid transom the element nearest to the transom will preferably narrower than an element next to it.

What I claim is:

1. A deck for an inflatable boat comprising:

a plurality of parallel elongate deck elements each having an upper and lower surface and arranged in a side by side relationship so as to be in a plane when in a first condition, adjacent sides of said elements configured so as to have an interengagement means for preventing relative translational movement of said deck elements out of the plane while at the same time permitting relative angular movement out of the plane; and link means for connecting said adjacent sides of said deck elements in the side by side relationship, wherein said link means remains connected upon said relative angular movement and said interengagement means disengages upon a predetermined degree of said relative angular movement.

2. A deck according to claim 1, wherein said adjacent sides of said deck elements are configured so that one of said sides has a tongue element, the adjacent side opposite thereof having a fitting groove element, said interengagement means is engaged when said tongue element is fitted into said groove element and disengaged upon said relative angular displacement of said deck elements.

3. A deck according to claim 1, wherein at least one of said adjacent sides of said deck elements are configured so as to have a restricted mouth-channel and said link means is constructed of a resilient flexible substance, at least one end of which is formed as an enlarged bead for fitting into the restricted mouth-channel on said adjacent side and allowing for a relative angular displacement of said deck elements of up to 180 degrees.

4. A deck for an inflatable boat as claimed in claim 1, wherein at least one end of said link means is permanently secured to one of said sides of said deck elements.

5. A deck for an inflatable boat as claimed in claim 1, wherein said link means is constructed of a resilient substance of constant cross section along its length, proximal to said upper surface and defining a composite pivot for the relative angular displacement of said deck elements of up to 180 degrees.

6. A deck for an inflatable boat as claimed in claim 1, further comprising an edge sealing element affixed to at least one of said sides of said deck elements to enclose said interengagement means.

7. A deck for an inflatable boat comprising:

a plurality of parallel elongate deck elements having an upper and lower surface arranged in a side by side relationship so as to be in a plane when in a first condition;

a plurality of capping elements having an inner surface and an outer surface wherein said inner surface of one of said capping elements is affixed to each of said adjacent sides of said deck elements, said outer surfaces of said capping elements configured so as to have an interengagement means for preventing relative translational movement of said deck elements out of the plane while at the same time permitting relative angular movement out of the plane; and link means for connecting said capping elements whereby said deck elements remain in the side by side relationship and remain connected upon said relative angular movement and said interengagement means disengages upon a predetermined degree of said relative angular movement.

8. A deck according to claim 7, wherein said outer surfaces of said capping elements affixed to said adjacent sides are configured so that one of said outer surfaces has a tongue element, the adjacent outer surface opposite thereof having a fitting groove element, said interengagement means is engaged when said tongue element is fitted into said groove element and disengaged upon said relative angular displacement of said deck elements.

9. A deck according to claim 7, wherein at least one of said outer surfaces of said capping elements are configured so as to have a restricted mouth-channel, said link means is constructed of a resilient flexible substance at least one end of which is formed as an enlarged bead for fitting into the restricted mouth-channel allowing for the relative angular displacement of said deck elements of up to 180 degrees.

10. A deck for an inflatable boat as claimed in claim 7, wherein said link means are constructed of a resilient substance of constant cross section along its length, proximal to said upper surface and defining a composite pivot for the relative angular displacement of said deck elements of up to 180 degrees.

11. A deck for an inflatable boat as claimed in claim 7, wherein at least one end of said link means is permanently secured to one of said capping elements.

12. A deck for an inflatable boat as claimed in claim 7, further comprising an edge sealing element affixed to at least one of said capping elements to enclose said interengagement means.

13. A deck for an inflatable boat comprising:

a plurality of deck elements in a side by side relationship so as to be in a plane when in a first condition; interengagement means at adjacent sides of said plurality of deck elements for preventing relative translational movement of the elements out of the plane while at the same time permitting relative angular movement of the elements out of the plane; and link means for engaging the adjacent sides of the elements and maintaining the elements in the side by side relationship, wherein said link means remains engaged between the elements upon said relative angular movement and interengagement means disengaging upon a predetermined degree of movement.

14. A deck for an inflatable boat as claimed in claim 13, wherein the link means is a resilient, flexible element comprising engagement means at opposite edges thereof for engagement with the adjacent deck elements.

15. A deck for an inflatable boat as claimed in claim 14 wherein at least one of said deck elements is configured so as to have a restricted-mouth channel at one side thereof and at least one of said interengagement means comprises an enlarged bead for engagement with said channel.

16. A deck for an inflatable boat as claimed in claim 14 wherein at least one of said interengagement means is permanently secured to one of the plurality of deck elements.

17. A deck for an inflatable boat as claimed in claim 13 wherein the elements comprise deck panels arranged side by side with an edge capping strip at adjacent sides thereof, which edge capping strip bears the interengagement means and link means.

18. A deck for an inflatable boat according to claim 13 wherein the elements are formed as single bodies.

19. A deck for an inflatable boat comprising:

a plurality of parallel elongate elements arranged side by side and having upper and lower surfaces and major elongate sides, which oppose each other;

link means for interconnecting said sides in a planar condition proximal to a first one of said surfaces defining a composite pivot for relative angular displacement of said adjacent elements of up to 180 degrees; and interengagement means proximal to second one of said surfaces for resisting relative translational movement of said adjacent elements comprising tongue and groove elements extending lengthwise of said elongate sides and becoming disengaged upon a predetermined degree of said relative angular displacement.

20. A deck, as claimed in claim 19, wherein said link means for engaging said adjacent sides of said parallel elongate elements comprises a resilient member of constant cross section along its length.

21. A deck, as claimed in claim 20, wherein at least one of said parallel elongate elements is formed as a single body having upper and lower surfaces and said sides, said engagement with at least one of said elements is by an enlarged bead on said resilient member entrapped in a channel in said element.

22. A deck as claimed in claim 19 wherein said upper surface is said first surface and said lower surface is said second surface.

23. A deck for an inflatable boat comprising:

a deck being substantially in a plane when in first condition and comprising a plurality of elongate members in a side by side relationship;

interengagement means along adjacent sides of said members for maintaining the elements against relative translational movement out of said plane when in a first condition and relative angular movement of adjacent elements in one direction disengaging said means; and link means for engaging said adjacent sides of said elongate members permitting relative angular movement of said elements.

24. A deck according to claim 23 wherein the deck is adapted to remain in a fixed position within the boat when the boat is inflated or deflated.

25. A deck for an inflatable boat comprising: a plurality of deck elements in a side by side relationship;

interengagement means comprising tongue and groove elements on adjacent sides of said deck elements and extending lengthwise of said sides for preventing relative translational movement of the elements out of the plane while at the same time permitting relative angular movement of the elements out of the plane and being disengaged upon a predetermined degree of said movement; and link means for engaging the adjacent sides of said elements in the side by side relationship, wherein said link means define a composite pivot for relative angular movement of adjacent elements and remain engaged between the elements upon said movement.

* * * * *